US007804381B2

(12) United States Patent
Stafford

(10) Patent No.: US 7,804,381 B2
(45) Date of Patent: Sep. 28, 2010

(54) BROADCAST SIGNAL WAVEGUIDE

(75) Inventor: Gary Stafford, Stevenage (GB)

(73) Assignee: Invacom Ltd., Stevenage, Hertsfordshire (GB)

( * ) Notice: Subject to any disclaimer, the term of this patent is extended or adjusted under 35 U.S.C. 154(b) by 164 days.

(21) Appl. No.: 11/574,838

(22) PCT Filed: Sep. 8, 2005

(86) PCT No.: PCT/GB2005/003463

§ 371 (c)(1),
(2), (4) Date: Apr. 26, 2007

(87) PCT Pub. No.: WO2006/027588

PCT Pub. Date: Mar. 16, 2006

(65) Prior Publication Data

US 2008/0186110 A1 Aug. 7, 2008

(30) Foreign Application Priority Data

Sep. 8, 2004 (GB) ..... 0419884.2

(51) Int. Cl.
*H01P 5/12* (2006.01)

(52) U.S. Cl. ..... 333/137; 333/108; 333/113; 333/122; 333/135

(58) Field of Classification Search ..... 333/100, 333/108, 113, 114, 122, 135, 137, 239
See application file for complete search history.

(56) References Cited

U.S. PATENT DOCUMENTS 2,682,610 A * 6/1954 King ..... 343/858
4,504,806 A * 3/1985 Conn et al. ..... 333/241
4,725,797 A * 2/1988 Thompson et al. ..... 333/212
7,034,774 B2 * 4/2006 Kuo et al. ..... 343/909

FOREIGN PATENT DOCUMENTS

EP 0 295 812 A 12/1988
EP 0 419 892 A 4/1991
JP 54114155 A * 9/1979
JP 05 110302 A 4/1993

OTHER PUBLICATIONS

Stuzhin et al., "Equipment for Multiplexing the Waveguide Channels of Radio-Relay Systems," Telecommunications and Radio Engineering 29/30(3):32-34 (1975).

* cited by examiner

*Primary Examiner*—Robert Pascal
*Assistant Examiner*—Kimberly E Glenn
(74) *Attorney, Agent, or Firm*—Nixon Peabody LLP

(57) ABSTRACT

A waveguide for use in apparatus for receiving transmitted data signals is provided. The waveguide includes first, second and third channels with the received data entering the first channel and components of the received data, signals being selectively deflected from the first channel into the second or third channels. The form of the components depends on whether the data signals have circular or linear polarity. The components leave the waveguide in substantially the same phase as which they entered the waveguide thereby allowing the same to be subsequently processed. The provision of the waveguide allows the receiving apparatus to be used to receive data signals with either circular and/or linear polarity and be subsequently processed.

20 Claims, 2 Drawing Sheets

BROADCAST SIGNAL WAVEGUIDE

Figure 1A:
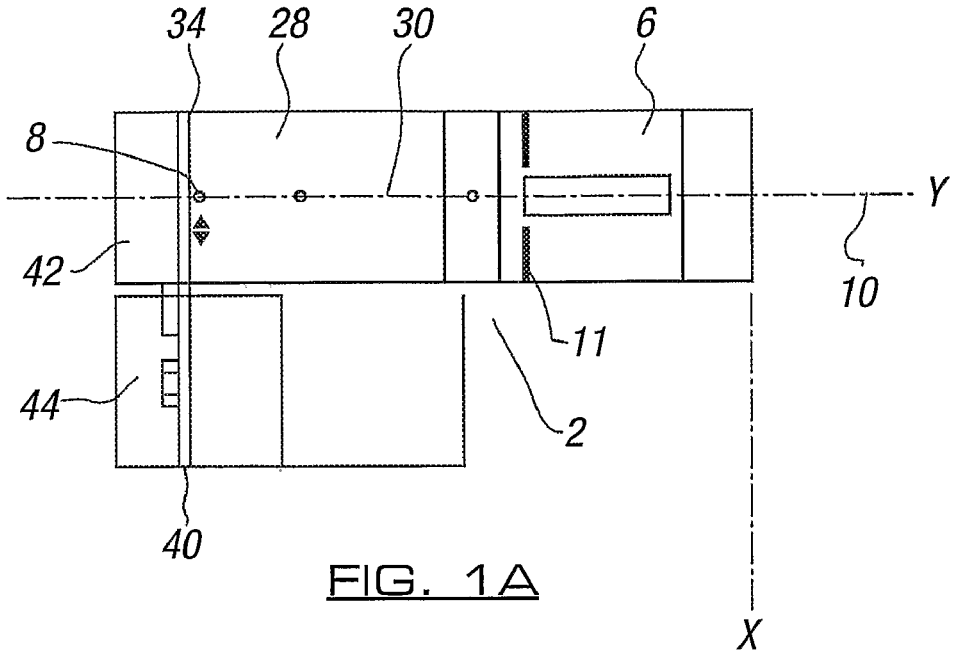
Figure 1B:
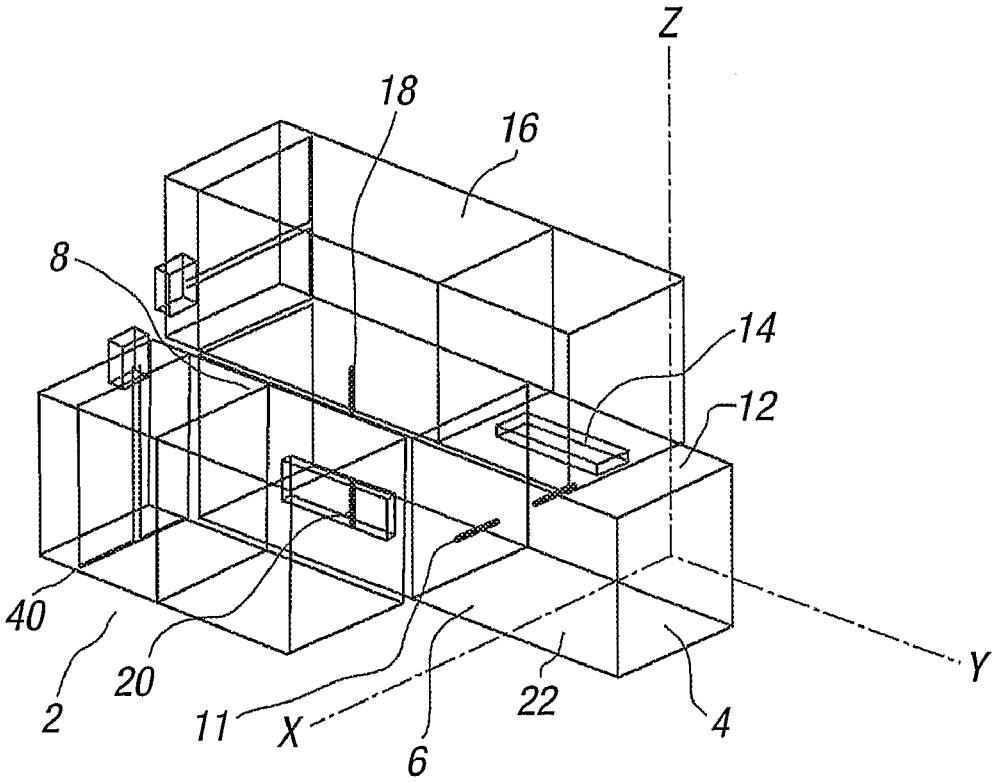
Figure 1C:
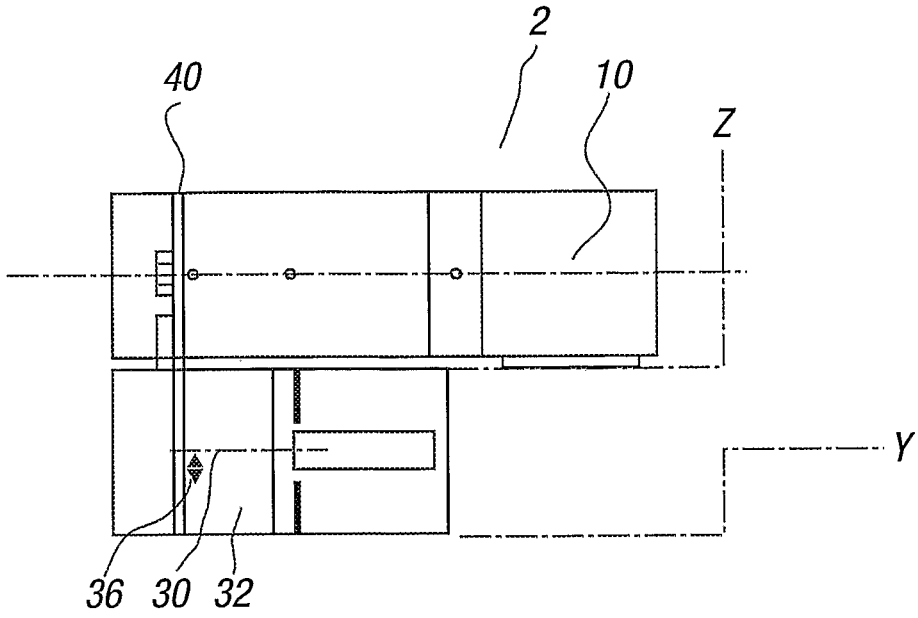
Figure 1D:
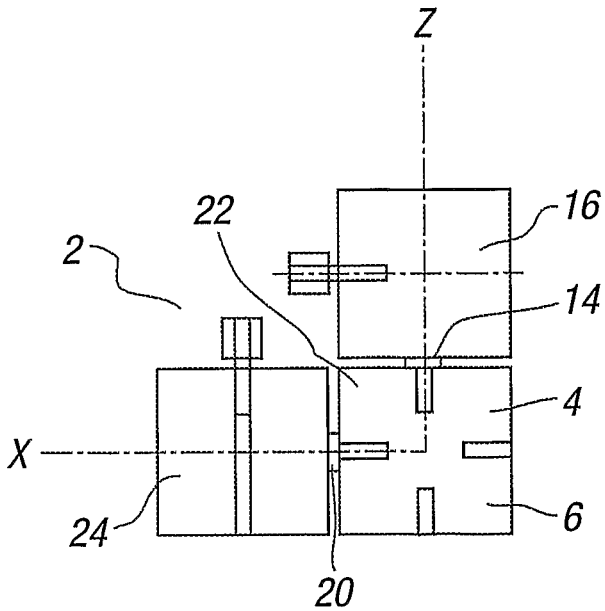

This application is a national stage application under 35 U.S.C. §371 from PCT Application No. PCT/GB2005/003463, filed Sep. 8, 2005, which claims the priority benefit of Great Britain Application No. 0419884.2, filed Sep. 8, 2004.

The invention to which this application relates is a waveguide apparatus for use in the reception of radio frequency signals of first and second polarity types such as circular and linear polarity.

The provision of waveguide apparatus to receive two different forms of broadcast signals is known and one known apparatus is called an OMT waveguide. In this waveguide, there is provided an input into which all the received signals pass to go along a channel. Provided intermediate the input and output of said channel, there is provided a signal deflector which causes a portion of the received signals, of a first polarity type, to be deflected in a direction perpendicular to the said channel and be directed in said second direction to an outlet along a second channel. The remainder of the frequency signals, typically the signals of the second polarity type, pass the deflector and move towards the outlet of the first channel such that when the first and second sets of radio frequency signals leave the OMT waveguide, they do so in first and second, perpendicular directions. While this form of waveguide can be of use in particular instances, as it provides isolation between the emitted first and second polarity types the same is not of use when it is required that the first and second set of radio frequency signals are matched in phase which can also be referred to as "matched in phase", as the first and second set of signals are emitted at different locations and in different directions, having passed along different distances and as a result when the same are emitted they are not coherent i.e they are not balanced in terms of phase. This can cause the subsequent processing of the signals to be disturbed and unacceptable.

The aim of the present invention is to provide a waveguide apparatus which allows for the separation of first and second sets of received signals in a manner so as to allow the first and second sets to be subsequently processed separately and to do so in a manner which allows the same to be matched in phase where the same are emitted from the waveguide and hence allow the same to be processed subsequently in the same phase.

In a first aspect of the invention there is provided waveguide apparatus for use with received data, said apparatus including an inlet into a first channel into which received signals of at least one polarity signal type pass, said first channel having located therein a first deflection means which causes at least one component of said signal type or types to be deflected to leave said channel through an aperture in the same into a second channel, and a second deflection means which causes at least a further component of said signal type or types to be deflected to leave said channel through an aperture in the same into a third channel and wherein said components are guided through said channels to outlets in substantially the same phase.

Typically the distances traveled by the said components from entering the waveguide to leaving the same at their respective outlets are substantially the same.

Typically the waveguide structure comprises three parallel channels. In a preferred embodiment the channels each have the same cross sectional shape, preferably square, although in principle these could be of different shapes.

Typically the first channel interfaces with a data transmission receiving feedhorn or antenna which receives a first (linear polarity) and second (circular polarity) signal types, typically from a satellite, although terrestrial, or coaxial data communication systems could be interfaced with the waveguide.

Typically the first channel of the waveguide can support both Vertical (V) and Horizontal (H) components of the linear polarisation signal type and Left and Right hand components of the circular polarisation signal type.

Typically the apertures in the first channel are provided, one in each orthogonal plane; to couple the signal types into the adjacent second and third channels. Typically the second and third channels carry one of the two orthogonal components of the incoming signal.

In the case of linear polarisation signal types the two orthogonal signal components will be pure vertical in one of the second or third channels and pure horizontal in the other of the second or third channels. In the case of circular polarisation the two orthogonal signals represent orthogonal components of both left and right hand polarisations, so that the second and third channels each carry half of the left hand circular polarisation and half of the right hand circular polarisation simultaneously.

As the paths of the two orthogonal signal components are of substantially the same length, when the components leave the waveguide outlets, typically on waveguide probes at a PCB interface, the orthogonal components have substantially the same phase relationship to each other as when they entered the first channel. This is of primary importance for Circular Polarity signal types.

In one embodiment the signal type components upon leaving the first channel through their respective apertures move in an initial direction which is substantially perpendicular to the direction of movement along the first channel and then are further deflected by the walls of the respective channels to move along their respective channels towards outlets, said outlets lying in the same plane.

Typically the components move along the respective second and third channels along a path which is substantially parallel with the direction of movement along the first channel.

Thus, in accordance with the invention, the said first and second components of the received signal are separated thereby allowing subsequent processing of the same to be achieved in isolation and, at the same time, due to the configuration of the first channel and parallel channels along which the deflected radio frequency signals pass and the provision of the outlets of said further channels in the same plane, the separated signals which are emitted from the waveguide apparatus are matched in phase as the length of the paths which the signal types follow is substantially the same.

In one embodiment, all of the channels are defined within a housing, typically of a metal or metal alloy.

In one embodiment, each of the channels is of a common cross sectional area and cross sectional shape. In one embodiment, the cross sectional shape of each channel is square.

In one embodiment, the first channel is linear and has an outlet, and said outlet can be masked but typically, it does not require to be masked as the first and second deflection means cause all of the received signal type components to be deflected from and out of the first channel and into the respective second or third channels prior to reaching the outlet.

In one embodiment, the apertures in the first channel adjacent each of the deflection means are rectangular in shape, with a first aperture formed on a first side of the channel and a second aperture formed on another side of the channel.

In one embodiment, the first and second deflection means are circular cross sectional pins which are mounted in the first channel and which act as a short circuit for a particular type of signals and hence deflect the same into the aperture formed in the wall of the first channel adjacent thereto.

In a further aspect of the invention there is provided a waveguide for use with apparatus to receive data signals transmitted in linear and circular polarity signal types, said waveguide allowing the passage of data signal types in either format therethrough by selectively splitting the received data signals into first and second components for passage along at least part of the waveguide.

Typically the format of the components is dependent upon the polarity of the received data signals.

In a further aspect of the invention there is provided apparatus for receiving transmitted circular or linear polarity signal types, said apparatus including a feedhorn or antenna to receive said data, interfaced with a waveguide, said waveguide including an inlet into a first channel into which the received signals pass, said first channel having located therein a first deflection means which causes a first orthogonal component of said data to be deflected to leave said channel through an aperture in the same, and a second deflection means disposed downstream from the first deflection means which causes a further component of the said data to be deflected to pass through an aperture and wherein said first and second components are guided towards respective outlets from the said waveguide and the distances traveled by said first and second components from the point of entry into the first channel to leaving the waveguide via the respective outlets, are substantially the same.

Typically the linear polarity and circular polarity signal types are transmitted from a satellite.

A specific embodiment of the invention is now described with reference to the accompanying drawings, wherein:—

Figure 2:
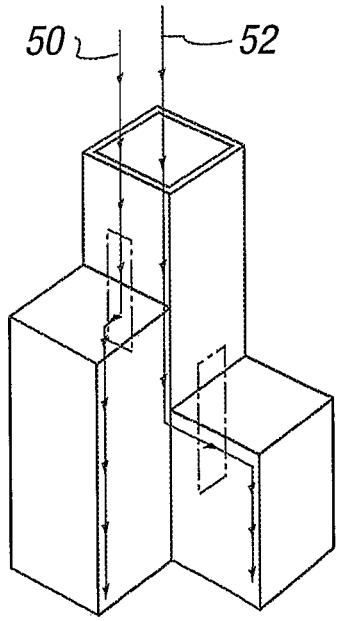

FIGS. 1*a* to *d* illustrate a waveguide apparatus in accordance with one embodiment of the invention; and FIG. 2 illustrates the passage of the first and second sets of signals as they pass through the waveguide apparatus of FIGS. 1*a* to *d*.

Referring firstly to FIGS. 1*a* to *d*, there is illustrated a waveguide apparatus in accordance with the invention which can be used to allow the separation and subsequent processing in an effective manner, of components of received circular and/or linear polarity signals or types typically via a satellite antenna. This thereby allows the waveguide and the receiving apparatus generally to be used to receive both polarity signal types whereas conventionally the receiving apparatus would only be able to receive circular or linear polarity signal types.

It is envisaged that first and second sets of signals will increasingly be transmitted to receiving apparatus with circular polarity or linear polarity to allow a greater radio frequency range to be used and hence allow a greater choice to users of the receiving apparatus in terms of television and/or radio channels which can be selected. As a result of this it is subsequently required to process the said circular and linear polarity signals with the same being matched in phase and the waveguide as described herein allows this to occur.

The waveguide apparatus 2 has an inlet 4 into which all received radio frequency signals pass having been received from the feedhorn or antenna with which the inlet interfaces. The inlet 4 leads into a first channel 6 which has an outlet at the opposite end 8 but through which no signals pass as will be illustrated herein.

The first channel 6 is linear and has a longitudinal axis 10. Provided at a first intermediate location on the first channel, is a first deflector pin 11. Adjacent the said deflector pin and on a first wall 12 of the first channel is provided an aperture 14. The deflector pin acts to deflect a first type or component of the received signals out of the first channel 6 and through the aperture leading into a second channel 16. Another type or component of the received radio frequency signals move along the first channel until they reach the second deflector pin 18. This deflector pin 18 causes the second type or component of the received signal to pass through an aperture 20 in the side wall 22 of the first channel and into a third channel 24.

As a result, in this example, no or only a few signals will still be left in the first channel downstream of the second deflector pin 18. The second and third channels, 16, 24 both include a section 28, 32 respectively which has a longitudinal axis 30 which is parallel to the longitudinal axis of the first channel as shown. The sections 28, 32 allow the passage of the first and second types or components of the received signals along said second and third channels in a guided manner. The outlets 34, 36 of the channels 16, 24 are provided at a common plane 40 as shown and from there the first and second types or components of the received signals are passed, matched in phase for further processing by probes 42, 44 separately as required.

As, in each case, the first and second components of the received signals pass along a path of the same distance and are emitted via outlets 34,36 in a common plane, so the first and second components are matched in phase as well as isolated.

FIG. 2 illustrates in schematic manner, the waveguide apparatus in accordance with the invention and the manner in which the first and second types or components of received signals are directed to pass through the waveguide. The arrows 50, in solid lines, indicate the passage of a first type or component of the received signal and the arrows 52 in broken lines indicate the passage of the second type or component of the received signals.

The cross sectional shape and size of the channels along which the signal types or components is preferably nominally the same to maintain the matching phase of the signal types. Furthermore the outlets of the channels are preferably provided in the same plane so that the distance to the outlets is the same.

Thus in accordance with a practical implementation of the invention, the waveguide structure comprises 3 adjacent square channels, 6, 16, 24. The first channel 6 will generally interface to a feedhorn or antenna (not shown) which can be mounted on an external wall of a building to receive data signals of either or both of linear or circular polarity signals from typically a satellite but it could also could be terrestrial or even interfaced to coaxial connectors.

The waveguide can support both V and H linear polarisations and Left and Right hand circular polarisations of the received data signals and therefore allows the processing of both via one set of receiving apparatus thereby allowing the widening of the radio frequency of data signals which can be received and processed.

The channel has 2 apertures 14, 20 along its length, one in each orthogonal plane. These apertures couple the received signal components into one or other of the adjacent two channels 16,24. Each of the adjacent channels carries one of the two orthogonal components of the received signal type.

For example, in the case of linear polarity received signals these two orthogonal components will be a pure vertical component which are deflected into channel 16 and a pure horizontal components deflected into the channel 24. In the case of circular polarisation the orthogonal components represent left and right hand circular polarisations so in effect the first component which passes along channel 16 includes half of the left hand circular polarisation and half of the right hand circular polarisation and the other channel 24 carries the other halves of the left and right hand circular polarisations simultaneously.

As the two paths along which the components pass are substantially of identical length, when the two orthogonal components are extracted from the adjacent waveguide ends, typically on waveguide probes at the PCB interface, they have almost the same phase relationship to each other as when they entered the main waveguide; which is primarily of importance for circular polarity signals. Additionally, the waveguide is frequency dispersive and so any dispersion effects are effectively cancelled out due to the effective waveguide paths of the orthogonal components being nearly identical. This allows for near perfect extraction of the circularly polarised signals with very low cross-polar interference. In one embodiment the extraction can be performed using a phase shifting network, most typically a 3 dB hybrid or similar.

There is therefore provided in accordance with the invention a waveguide apparatus which provides for the effective separation of first and second types or components of received radio frequency signals and furthermore, allows for the emission of the separated radio frequency signals in a matched in phase manner.

The invention claimed is:

1. A waveguide apparatus for use with received data, said waveguide apparatus including an inlet into a first channel into which received signals pass, said received signals including two orthogonal components of at least one polarization, said first channel having located therein a first deflection means which causes at least a first component of said polarization to be deflected to leave said first channel through a first aperture in the first channel into a second channel, and a second deflection means which causes at least a second component of said polarization to be deflected to leave said first channel through a second aperture in the first channel into a third channel, wherein said components are guided through said second and third channels to outlets in substantially the same phase wherein distances travelled by said first and second components of said polarization between entering the waveguide apparatus at the inlet and leaving the waveguide apparatus at said respective outlets are substantially the same.

2. The waveguide apparatus according to claim 1, wherein the first, second, and third channels are parallel.

3. The waveguide apparatus according to claim 2, wherein the three parallel channels each have the same cross sectional shape.

4. The waveguide apparatus according to claim 1, wherein the first channel interfaces with a data transmission receiving feedhorn or antenna.

5. The waveguide apparatus according to claim 1, wherein the first channel of the waveguide apparatus can support both Vertical (V) and Horizontal (H) components of a linear polarity signal and Left and Right hand components of a circular polarity signal.

6. The waveguide apparatus according to claim 1, wherein the first and second apertures in the first channel are provided, one in each orthogonal plane.

7. The waveguide apparatus according to claim 1, wherein in the case of a received linear polarity signal the two orthogonal components are vertical and horizontal components, one of which enters the second or the third channel and the other of the vertical and horizontal components enters the other of the second or the third channels.

8. The waveguide apparatus according to claim 1, wherein in the case of a received circular polarity signal that includes left and right hand components, the first orthogonal component comprises half of the left hand component and half of the right hand component and the second orthogonal component comprises the remaining halves of the left and right hand components of the circular polarity signal.

9. The waveguide apparatus according to claim 1, wherein paths along which the two orthogonal components are deflected inside the waveguide apparatus are substantially the same length, and when the two orthogonal components leave said respective outlets of the second and third channels the two orthogonal components have substantially the same phase relationship to each other as when the two orthogonal components entered the first channel.

10. The waveguide apparatus according to claim 1, wherein at least one of the first and second components upon leaving the first channel through said respective first and second apertures, move in an initial direction substantially perpendicular to a direction of movement along the first channel.

11. The waveguide apparatus according to claim 1, wherein the outlets lie in substantially the same plane.

12. The waveguide apparatus according to claim 1, wherein said components are separated and thereby allow subsequent processing of the components to be achieved in isolation.

13. The waveguide apparatus according to claim 1, wherein the first, second, and third channels are defined within a waveguide housing formed of a metal or metal alloy.

14. The waveguide apparatus according to claim 1, wherein the first channel is linear and has an outlet.

15. The waveguide apparatus according to claim 1, wherein the first and the second deflection means are circular cross sectional pins mounted in the first channel and extend, at least partially, into said first channel.

16. The waveguide apparatus according to claim 15, wherein said first and second deflection means are provided in the first channel to lie with respective longitudinal axes perpendicular to each other.

17. The waveguide apparatus according to claim 15, wherein the first and the second deflection means are adjustable so as to allow adjustment of an extent to which the first and the second deflection means extend inwardly of said first channel.

18. The waveguide according to claim 1, wherein the format of the components is dependent upon the polarity of the received signals.

19. An apparatus for receiving transmitted circular or linear polarity signals, said apparatus including a feedhorn or antenna to receive data, interfaced with a waveguide, said waveguide including an inlet into a first channel into which the received circular or linear polarity signals pass, said first channel having located therein a first deflection means which causes a first orthogonal component of said data to be deflected to leave said first channel through a first aperture in the first channel, and a second deflection means disposed downstream from the first deflection means which causes a second orthogonal component of said data to be deflected to pass through a second aperture, and wherein said first and second orthogonal components are guided towards respective outlets from said waveguide, and wherein the distances traveled by said first and second components between entering the inlet into the first channel and the respective outlets from the waveguide are substantially the same.

20. The apparatus according to claim 19, wherein the circular or linear polarity signal types are transmitted from a satellite.

* * * * *